US008033647B2

(12) United States Patent
Xie et al.

(10) Patent No.: US 8,033,647 B2
(45) Date of Patent: Oct. 11, 2011

(54) LIQUID DROP DISPENSER WITH MOVABLE DEFLECTOR

(75) Inventors: Yonglin Xie, Pittsford, NY (US); Michael J. Piatt, Dayton, OH (US); Joseph Jech, Jr., Webster, NY (US); Qing Yang, Pittsford, NY (US)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 13/010,820

(22) Filed: Jan. 21, 2011

(65) Prior Publication Data

US 2011/0109699 A1 May 12, 2011

Related U.S. Application Data

(63) Continuation of application No. 11/944,658, filed on Nov. 26, 2007, now Pat. No. 7,914,109.

(51) Int. Cl.
*B41J 2/04* (2006.01)

(52) U.S. Cl. ..... 347/54

(58) Field of Classification Search ..... 347/54
See application file for complete search history.

(56) References Cited

U.S. PATENT DOCUMENTS

| | | | | |
|---|---|---|---|---|
| 3,451,621 | A | 6/1969 | Splinter | |
| 3,596,275 | A | 7/1971 | Sweet | |
| 3,972,051 | A | 7/1976 | Lundquist et al. | |
| 4,097,872 | A | 6/1978 | Hendriks et al. | |
| 4,106,032 | A | 8/1978 | Miura et al. | |
| 4,297,712 | A | 10/1981 | Lammers et al. | |
| 4,345,259 | A | 8/1982 | Reitberger | |
| 4,728,969 | A | 3/1988 | Le et al. | |
| 5,581,286 | A | 12/1996 | Hayes et al. | 347/71 |
| 6,065,825 | A | 5/2000 | Anagnostopoulos et al. | |
| 6,220,694 | B1 | 4/2001 | Silverbrook | 347/54 |
| 6,318,829 | B1 | 11/2001 | Suzuki | 347/11 |
| 6,357,115 | B1 | 3/2002 | Takatsuka et al. | |
| 6,464,341 | B1 | 10/2002 | Furlani et al. | 347/54 |
| 6,474,795 | B1 | 11/2002 | Lebens et al. | |
| 2005/0007433 | A1 | 1/2005 | Inoue et al. | 347/100 |
| 2005/0225601 | A1 | 10/2005 | Siverbrrook | 347/54 |
| 2008/0158321 | A1 | 7/2008 | Nitta et al. | 347/89 |

FOREIGN PATENT DOCUMENTS

| | | |
|---|---|---|
| EP | 0 436 509 | 7/1991 |
| EP | 0436509 | 7/1991 |
| WO | 95/10415 | 4/1995 |
| WO | WO 95/10415 | 4/1995 |

OTHER PUBLICATIONS

Wikipedia Article-Convex, Paragraph 1.

*Primary Examiner* — Matthew Luu
*Assistant Examiner* — Lisa Solomon
(74) *Attorney, Agent, or Firm* — William R. Zimmerli

(57) ABSTRACT

A liquid dispenser includes a liquid supply channel and a liquid ejector channel that includes an outlet opening. A liquid supply provides a flow of a pressurized liquid through the liquid ejector channel from the liquid supply channel. The pressurized liquid has a momentum as the liquid moves through the liquid ejector channel. A liquid return channel receives the liquid after the liquid passes through the liquid ejector channel. A diverter member forms at least a portion of a wall of the liquid ejector channel. A portion of the diverter member is selectively movable into the liquid flowing through the liquid ejector channel. The momentum of the liquid causes some of the liquid to be diverted through the outlet opening when the portion of the diverter member is moved into the liquid flowing through the liquid ejector channel.

12 Claims, 8 Drawing Sheets

LIQUID DROP DISPENSER WITH MOVABLE DEFLECTOR

CROSS REFERENCE TO RELATED APPLICATIONS

This is a continuation application of U.S. application Ser. No. 11/944,658 filed Nov. 26, 2007 now U.S. Pat. No. 7,914,109.

Reference is made to commonly assigned, co-pending U.S. patent application Ser. No. 13/010,815, which is a continuation application of U.S. patent application Ser. No. 12/024,360, filed in the name of Eastman Kodak Company on Feb. 1, 2008.

FIELD OF THE INVENTION

This invention relates generally to the field of fluid dispensers and particularly, but not exclusively, to an on-demand dispenser of very small quantities of liquid. The invention is particularly useful in digitally controlled ink jet printing devices wherein droplets of ink are ejected from nozzles in a printhead toward a print medium.

BACKGROUND OF THE INVENTION

Traditionally, color ink jet printing is accomplished by one of two technologies, referred to as drop-on-demand and continuous stream printing. Both technologies require independent ink supplies for each of the colors of ink provided. Ink is fed through channels formed in the printhead. Each channel includes a nozzle from which droplets of ink are selectively extruded and deposited upon a medium. Typically, each technology requires separate ink delivery systems for each ink color used in printing. Ordinarily, the three primary subtractive colors, i.e. cyan, yellow and magenta, are used because these colors can produce up to several million perceived color combinations.

In drop-on-demand ink jet printing, such as shown in U.S. Pat. No. 6,065,825, ink droplets are generated for impact upon a print medium using a pressurization actuator (thermal, piezoelectric, etc.). Selective activation of the actuator causes the formation and ejection of a flying ink droplet that crosses the space between the printhead and the print medium and strikes the print medium. The energy to propel such droplets from the ejector comes from the pressurization activator associated with that ejector. The formation of printed images is achieved by controlling the individual formation of ink droplets at each ejector as the medium is moved relative to the printhead.

Conventional drop-on-demand ink jet printers utilize a pressurization actuator to produce the ink jet droplet from the nozzles of a printhead. Typically, one of two types of actuators is used including heat actuators and piezoelectric actuators. With heat actuators, a heater, placed at a to convenient location, heats the ink. This causes a quantity of ink to phase change into a gaseous steam bubble that raises the internal ink pressure sufficiently for an ink droplet to be expelled. With piezoelectric actuators, an electric field is applied to a piezoelectric material possessing properties that create a pulse of mechanical movement stress in the material, thereby causing an ink droplet to be expelled by a pumping action. The most commonly produced piezoelectric materials are ceramics, such as lead zirconate titanate, barium titanate, lead titanate, and lead metaniobate.

The volume of ink ejected by such nozzles is determined by the quantity of fluid ejected at each actuation of the drive mechanism, the velocity with which the fluid is ejected, and the rate of ejection. For a given geometry of the chamber, the pressure at which the fluid is supplied to the chamber and the operational characteristics of the drive mechanism determine all of those parameters. By increasing the supply pressure and the displacement of the drive mechanism in the forward stroke, either independently or as combined parameters, the ejection quality can be increased. However, if the supply pressure is to be increased substantially above the pressure at the outlet of the jet (which in printheads is generally atmospheric pressure), the fluid column cannot be contained in the chamber during the off periods of the dispenser i.e. during periods when no fluid is to be ejected from that particular jet. Fluid will therefore drip out of the jet during those periods. Hence, the most influential parameter in achieving high-quality drop-on-demand in these known dispensers is the maximum obtainable displacement of the drive mechanism, which is clearly limited.

The second technology, commonly referred to as continuous stream or continuous ink jet printing, uses a pressurized ink source for producing a continuous stream of ink droplets from each ejector. Typically, the pressurized ink is in fluidic contact with all the ejectors through a common manifold. The energy to propel droplets from the ejectors comes from the pressurization means pressurizing the manifold, which is typically a pump located remotely from the printhead. Conventional continuous ink jet printers utilize electrostatic charging devices that are placed close to the point where a filament of working fluid breaks into individual ink droplets. The ink droplets are electrically charged and then directed to an appropriate location by deflection electrodes having a large potential difference. When no print is desired, the ink droplets are deflected into an ink-capturing mechanism (catcher, interceptor, gutter, etc.) and either recycled or discarded. When printing is desired, the ink droplets are not deflected and allowed to strike a print media. Alternatively, deflected ink droplets may be allowed to strike the print media, while non-deflected ink droplets are collected in the ink capturing mechanism.

Other methods of continuous ink jet printing employ air flow in the vicinity of ink streams for various purposes. For example, U.S. Pat. No. 3,596,275 issued to Sweet in 1978 discloses the use of both collinear and perpendicular air flow to the droplet flow path to remove the effect of the wake turbulence on the path of succeeding droplets. This work was expanded upon in U.S. Pat. No. 3,972,051 to Lundquist et al., U.S. Pat. No. 4,097,872 to Giordano et al. and U.S. Pat. No. 4,297,712 to Lammers et al. in regards to the design of aspirators for use in droplet wake minimization. U.S. Pat. No. 4,106,032, to Miura and U.S. Pat. No. 4,728,969 to Le et al. employ a coaxial air flow to assist jetting from a drop-on-demand type head.

While this method does not rely on electrostatic means to affect the trajectory of droplets, it does rely on the precise control of the break off points of the filaments and the placement of the air flow intermediate to these break off points. Such a system is difficult to control and to manufacture. Furthermore, the physical separation or amount of discrimination between the two droplet paths is small further adding to the difficulty of control and manufacture. As such, these printheads suffer from a lack of precise control of the placement of drops on the print medium, which can produce visible image artifacts.

One problem associated with ink jet printers in general and such printers employing gas or air flows in particular is the drying of the ink. Ink drying in the vicinity of the printhead nozzles can lead to spurious droplet trajectories and nozzle clogging. In some cases, the evaporation of volatile ink solvents from the droplets as they fly through the air can increase the viscosity of to the ink captured by the gutter, thereby causing difficulties during the ink recycling operation when the recycled ink is passed through a filter. This last problem becomes particularly difficult if the loss of solvent in the ink is large enough to cause the pigments in the ink to coagulate. Yet another problem associated with the guttering of inks is that the gutter is provided with a negative pressure, and is thereby subject to sucking wind, dirt, and frothy mist into the ink to be recycled.

European Patent Application No. EP-A-0436509 describes a fluid dispenser comprising a main chamber to which fluid is fed under pressure and a pair of outlet channels. A dispensing outlet channel leads to a dispensing outlet, whilst a recirculation outlet channel conducts the fluid back into the fluid supply. In use, the fluid normally veers towards the recirculation outlet channel leading back to the fluid supply. When a drop of fluid is to be dispensed, a driver device is momentarily energized so that the fluid flow switches over to the dispensing outlet channel. As soon as the required quantity of fluid has been dispensed, the flow is switched back to the recirculation channel by energization of a second driver device, so that the fluid again circulates back to the fluid supply. A disadvantage of the fluid dispenser is that two driver devices are required at each nozzle. Another disadvantage is that each nozzle requires a large footprint on the printhead to accommodate the pair of driver devices.

WO 95/10415 discloses a fluid dispenser comprising a supply channel; fluid supply means for feeding said main fluid to the supply channel under pressure; a first fluid path along which the main fluid is fed from the supply channel; a second fluid path including a fluid dispensing outlet; a control channel containing control fluid and having a control outlet adjacent the first fluid path, and means for changing pressure in said control fluid such that a wave front is formed in the main fluid and a droplet of said main fluid is dispensed from the fluid dispensing outlet. The main fluid flow follows the first fluid path due to Coanda effect except when diverted by change of pressure of the control fluid. While this fluid dispenser overcomes the need for two driver devices in European Patent Application No. EP-A-0436509, droplets to be dispensed are unsupported as they depart from the main fluid flow to exit the fluid dispensing outlet. As such, these printheads suffer from a lack of precise control of the placement of drops on the print medium, which can produce visible image artifacts. U.S. Pat. No. 4,345,259 is quite similar to WO 95/10415, and is cited here for the sake of completeness.

SUMMARY OF THE INVENTION

According to a feature of the present invention, a liquid dispenser includes a liquid supply channel, a liquid supply adapted to feed a stream of liquid through the supply channel, a liquid return channel adapted to receive liquid from the supply channel, a liquid return channel adapted to receive liquid from the supply channel, a liquid dispensing outlet opening, and a diverter member selectively movable into the supply channel to divert droplets to the dispensing outlet opening.

According to another feature of the present invention, the liquid flows from the liquid supply channel to the liquid return channel by Coanda effect when not diverted.

According to still another feature of the present invention, the motion of the diverter member is substantially orthogonal to and opposes the direction of liquid flow, so that energy associated with moving the diverter member imparts no energy to the diverted droplets.

According to yet another feature of the present invention, the energy associated with moving the diverter member is less than 100 nJ per pL droplet volume. In some embodiments of the present invention, the energy associated with moving the diverter member is less than 10 nJ per pL droplet volume.

According to yet another feature of the present invention, the amount and duration of motion of the diverter member is selectively adjustable to control diverted droplet volume.

According to yet another feature of the present invention, the liquid dispenser has a response frequency greater than 400 kHz. The diverter member may be a thermal bimorph transducer, a piezoelectric transducer, an electrostatic transducer, a magnetic transducer, or other suitable member.

According to another feature of the present invention, a liquid dispenser includes a liquid supply channel and a liquid ejector channel that includes an outlet opening. A liquid supply provides a flow of a pressurized liquid through the liquid ejector channel from the liquid supply channel. The pressurized liquid has a momentum as the liquid moves through the liquid ejector channel. A liquid return channel receives the liquid after the liquid passes through the liquid ejector channel. A diverter member forms at least a portion of a wall of the liquid ejector channel. A portion of the diverter member is selectively movable into the liquid flowing through the liquid ejector channel. The momentum of the liquid causes some of the liquid to be diverted through the outlet opening when the portion of the diverter member is moved into the liquid flowing through the liquid ejector channel.

According to another feature of the present invention, the liquid flows from the liquid supply channel to the liquid return channel through the liquid ejector channel when the portion of the diverter member is not moved into the liquid flowing through the liquid ejector channel.

According to another feature of the present invention, the diverter member includes a surface along which some of the liquid flows when the portion of the diverter member is moved into the liquid flowing through the liquid ejector channel.

DETAILED DESCRIPTION OF THE INVENTION

The present description will be directed in particular to elements forming part of, or cooperating more directly with, apparatus in accordance with the present invention. It is to be understood that elements not specifically shown or described may take various forms well known to those skilled in the art.

Figure 1:
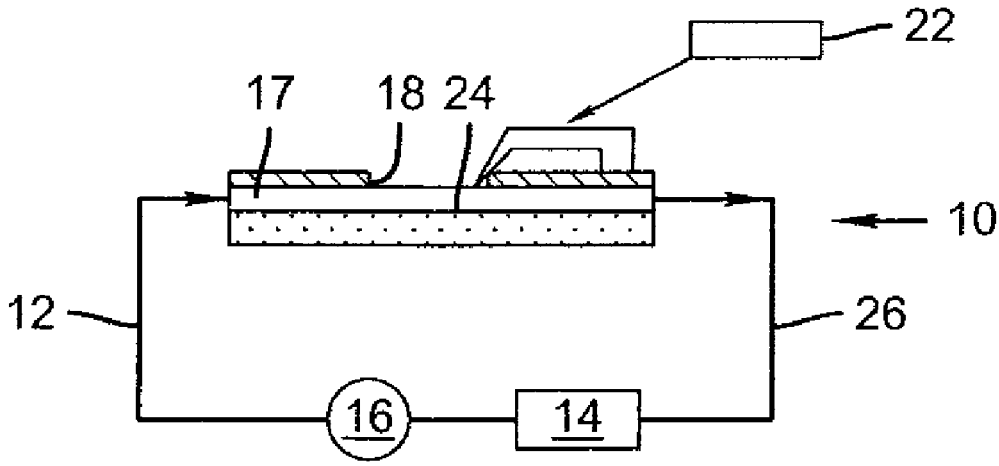
FIG. 1 is a schematic plan view of a dispenser made in accordance with a preferred embodiment of the present invention.

With reference to FIG. 1, a dispenser 10 according to a preferred embodiment of the present invention is formed from a semiconductor material (silicon, etc.) using known semiconductor fabrication techniques (CMOS circuit fabrication techniques, micro-electro mechanical structure (MEMS) fabrication techniques, etc.). However, it is specifically contemplated and therefore within the scope of this disclosure that dispenser 10 may be formed from any materials using any fabrication techniques conventionally known in the art.

A supply channel 12, which extends from a supply chamber 14, carries a liquid pressurized by a pump 16 to be dispensed, on demand, from an outlet opening 18. The liquid may be, for example, a printing ink. The liquid flows through ejector channel 17; and, when no drops are being ejected, flows entirely below outlet opening 18 at a velocity substantially equal to the velocity of the drops to be ejected from outlet opening 18 when fluid is being dispensed, as described below. The energy to sustain this flow is provided by pump 16 at all times.

Figure 2:
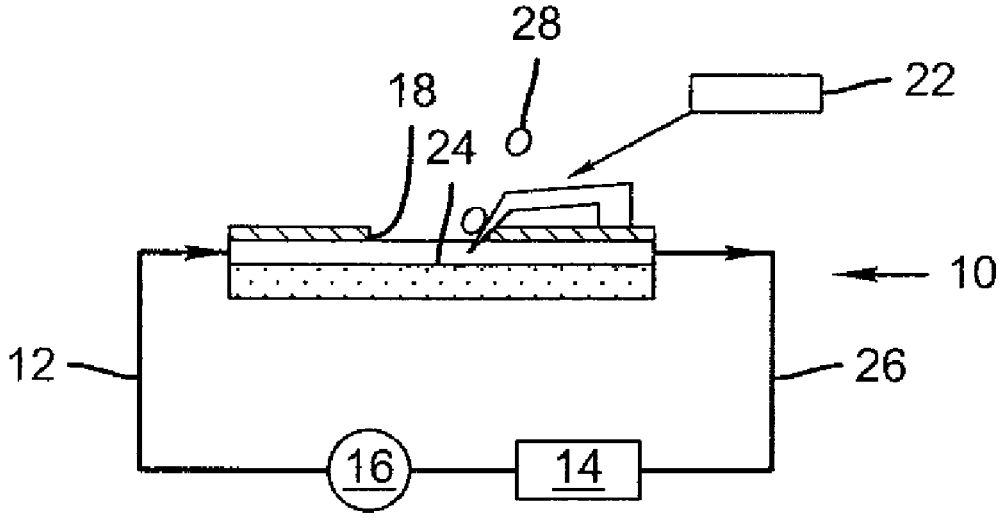
FIG. 2 is a schematic plan view of the dispenser of FIG. 1 in its "active" mode.

A diverter member 20 is selectively movable from a passive position illustrated in FIG. 1 to an active position as shown in FIG. 2 by a controller 22. When diverter member 20 is in its passive, FIG. 1 position, liquid flowing through supply channel 12 is normally held by the Coanda effect in contact with a wall region 24, so that it passes into a return channel 26, along which it can be returned to the supply chamber. When controller 22 moves diverter member 20 to its FIG. 2 active position, a portion of liquid flowing below outlet opening 18 flows along a ramp wall surface of the diverter member and emerges from the outlet opening due to the momentum of the liquid. Intermittent pulsing movement of diverter member 20 will shave-off liquid to deliver individual droplets 28 from the outlet opening 18.

It will therefore be apparent that each time diverter member 20 is momentarily moved to its active position, a droplet of the liquid is dispensed from the opening 18. The device can therefore be used in ink jet printing, and a number of the devices can be assembled side-by-side to form a printhead for dot matrix printing. This permits the dispensing of very closely spaced fluid droplets.

Specifically, the lag time between activation of diverter member 20 and separation of the liquid drop from diverter member 20 is very small, approximately equal to the ratio of the length of the diverter member divided by the velocity of the liquid in ejector channel 17. Preferably, the diverter member is no longer than, say, ten microns and the fluid velocity is in the range of from five to thirty meters per second. Accordingly, the time between activation of diverter member 20 and separation of the liquid drop from the diverter member is less than two microseconds. This corresponds to a response frequency, which is defined as the inverse of the lag time, of greater than 400 kHz. The energy to propel such droplets derives from pump 16, typically located remotely from the dispenser. Thus the dispenser and the printer so enabled are of the continuous inkjet type and the response time characterizing the lag between activation and drop ejection is very fast.

The dispenser may advantageously be micromachined from a block of material or fabricated by electroforming, electroplating, chemical etching or molding. Assembling separately-fabricated modules may alternatively form it. The dispenser may be used for depositing droplets for printing or for imaging applications, as well as other nonprinting applications where there is a requirement for dispensing precise volumes of fluids.

The dispenser of the present invention has a number of advantages over known devices. The velocity of emission of the droplet will directly depend on the supply pressure and not on control pressure, and the dispenser can thereby yield drop velocities in excess of twenty meters per second, which are much higher than those achievable with previous piezo-electric and thermal systems. The droplet size is controlled by the shape and position of the diverter member and the velocity of the liquid, and not by the dimensions of a nozzle. A dispenser in accordance with the invention may operate with a velocity and throw distance that exceeds those of previous devices. This enables deposits to be effected on surfaces which are further from the dispenser, which is required for industrial printing applications, such as printing on cans, boxes, containers, and the like.

Figure 3:
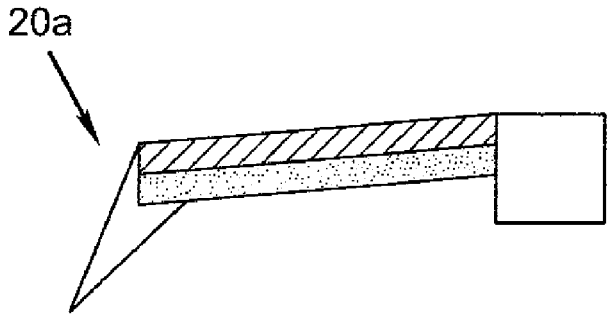
FIGS. 3-5 are detail views of a portion of the dispenser of FIG. 1 showing three preferred embodiments of the present invention.
Figure 4:
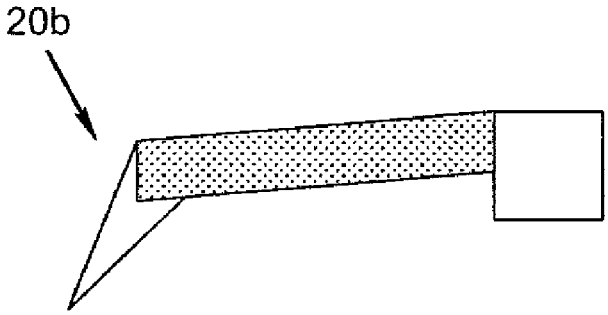
Figure 5:
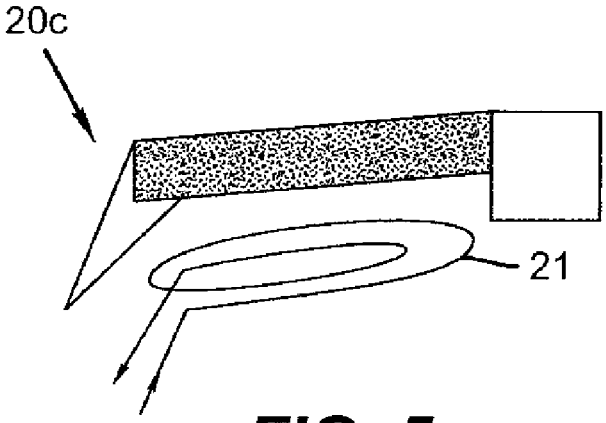

The present invention provides a monostable fluid control device, which requires only a single ejector channel 17 without an associated control channel. Actuation can be effected by any means capable of imparting movement of the diverter member into the fluid stream and advantageously such means may be an actuator such as thermal bimorphs as illustrated in FIG. 3 as 20*a*, piezoelectric transducers as illustrated in FIG. 4 as 20*b*, or electrostatic or magnetic transducers as illustrated in FIG. 5 as 20*c* with magnetic coil 21.

Figure 7:
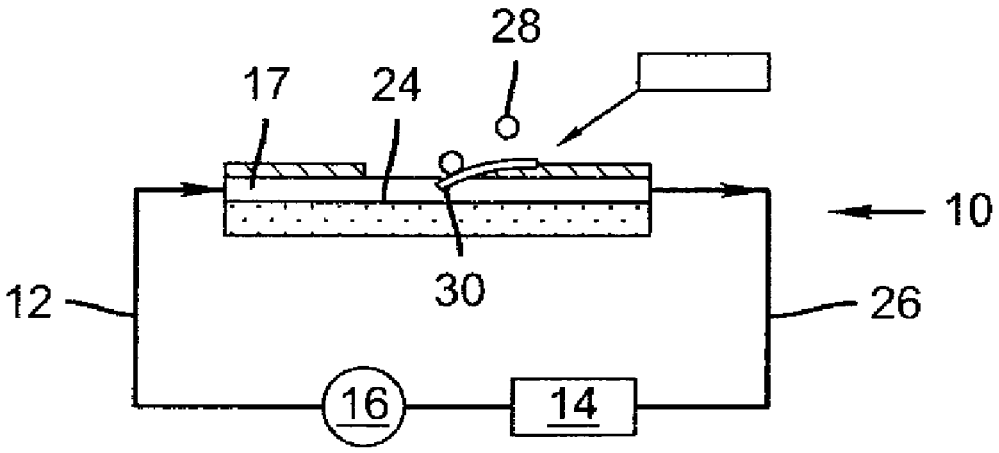
FIG. 7 is a schematic plan view of the dispenser of FIG. 6 in its "active" mode.
Figure 8:
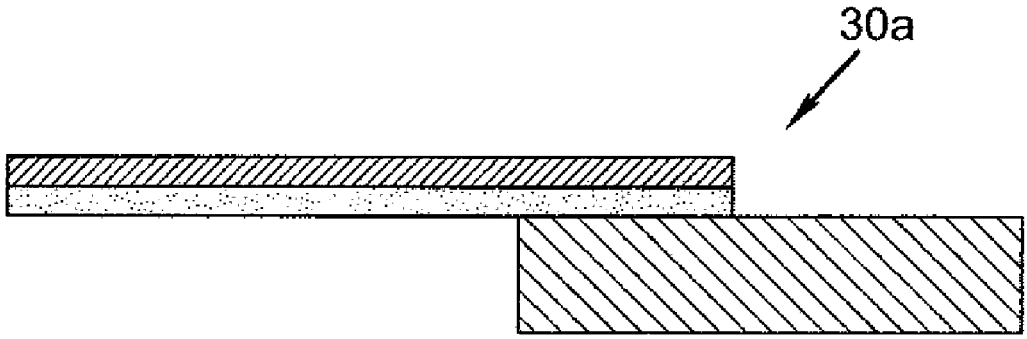
FIGS. 8 and 9 are detail views of a portion of the printhead of FIG. 1 showing two preferred embodiments of the present invention.
Figure 9:
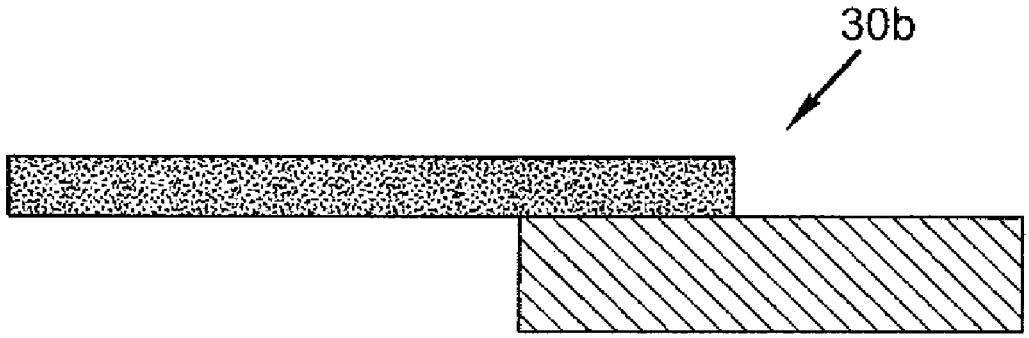

The transducer may be located in the ejector channel or could be arranged outside it. For example, referring to FIGS. 6 and 7, the walls of ejector channel 17 include a flexible portion that forms a diverter member 30. The diverter member may be deflected from a passive position illustrated in FIG. 6 to its active position of FIG. 7 by a piezoelectric transducer shown in FIG. 8 or by a piezoelectric transducer 30*b* shown in FIG. 9.

Figure 6:
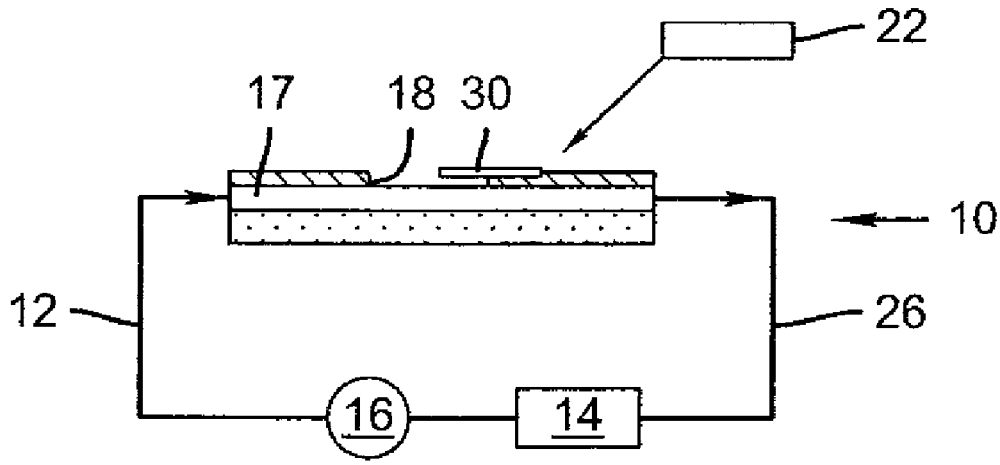
FIG. 6 is a schematic plan view of a dispenser made in accordance with another preferred embodiment of the present invention.

As can be seen from FIG. 6, diverter member 30 moves mechanically in a direction substantially orthogonal to the fluid flow or moves in a direction opposing fluid flow. Thus, the energy to launch the drops does not come from the diverter member itself, but comes instead from flow energy supplied by pump 16. This contrasts with the source of energy imparted to drops disclosed by the pressure increase mechanism of WO 95/10415 and U.S. Pat. No. 4,345,259 wherein energy is imparted to the ejected drops, as can be appreciated by one skilled in fluid mechanics. Thus the energy needed to activate the diverter member according to the present invention can be very small relative to the energy used by the afore mentioned prior art devices. In particular, for thermal bimorphs, the calculated energy to move the tip of the bimorph from its own equilibrium position to a position ten microns into the channel of FIG. 2 is typically less than 100 nJ for a motion that releases drops of at least one pL volume. Thus, the ejection energy required per pL volume, a common measure of ejector efficiency, is typically less than 100 nJ/pL. Piezo actuators can be more efficient than thermal actuators because they require no energy input to hold their actuated positions, as is well known in the art of inkjet ejectors, and thus the ejection energy required per pL volume for piezo actuators, such as those of FIG. 4, is calculated to be less than 10 nJ/pL. These energies are additionally low in cases for which the actuators remain in their actuated position for a substantial time.

Figure 10:
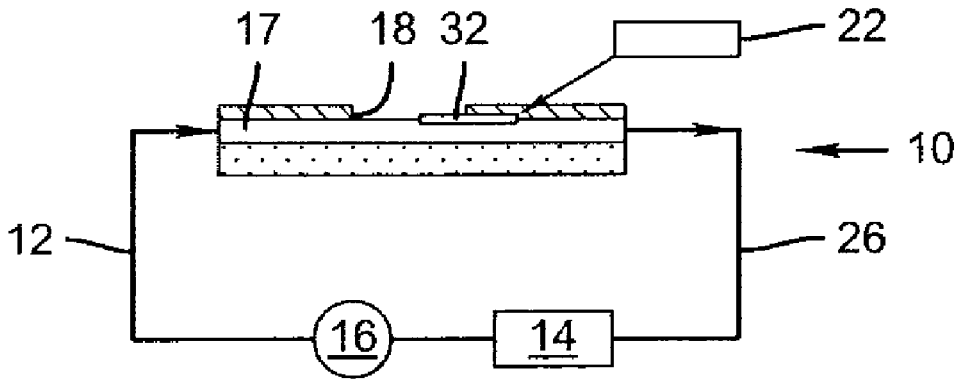
FIG. 10 is a schematic plan view of a dispenser made in accordance with still another preferred embodiment of the present invention.
Figure 11:
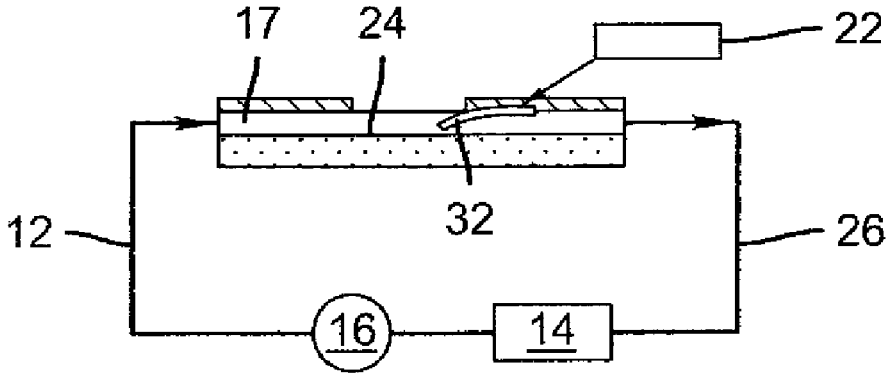
FIG. 11 is a schematic plan view of the dispenser of FIG. 9 in its "active" mode.

Referring to FIGS. 10 and 11, the walls of ejector channel 17 include a flexible portion that forms a diverter member 32. Diverter member 32 is similar to diverter member 30 of FIGS. 6 and 7, except that it is located on the inner wall of ejector channel 17 rather than on its outer wall. Diverter member 32 may be deflected from a passive position illustrated in FIG. 10 to its active position of FIG. 11 by a thermal bimorph, piezoelectric, electrostatic or magnetic transducer.

Figure 12:
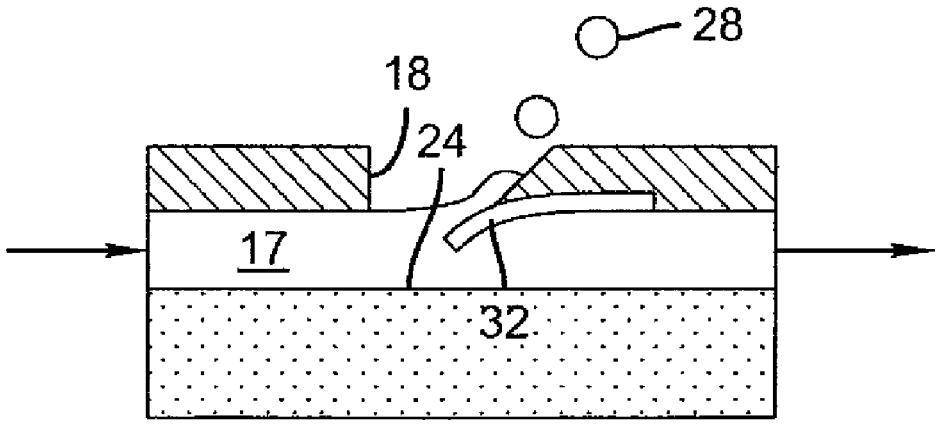
FIG. 12 is a detailed view of a portion of a dispenser made in accordance with yet another preferred embodiment of the present invention.

In FIG. 12, the wall of ejector channel 17 to which diverter member 32 is attached has been formed with a tapered edge as illustrated to enhance the ejection of droplets 28.

Figure 13:
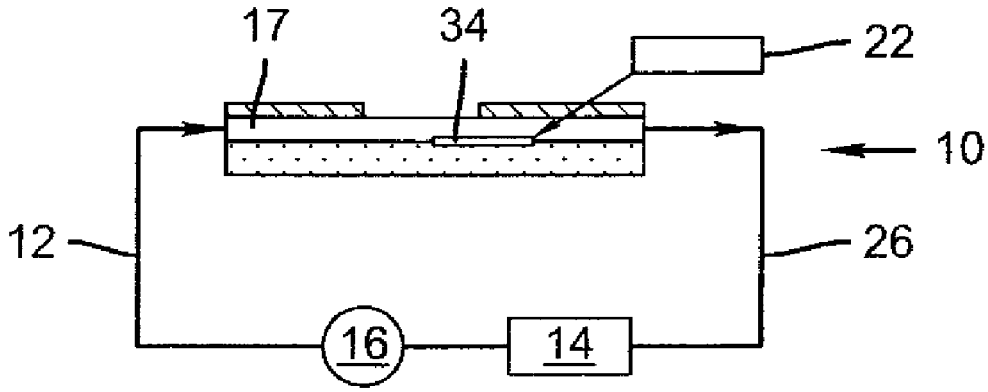
FIG. 13 is a schematic plan view of a dispenser made in accordance with still another preferred embodiment of the present invention.
Figure 14:
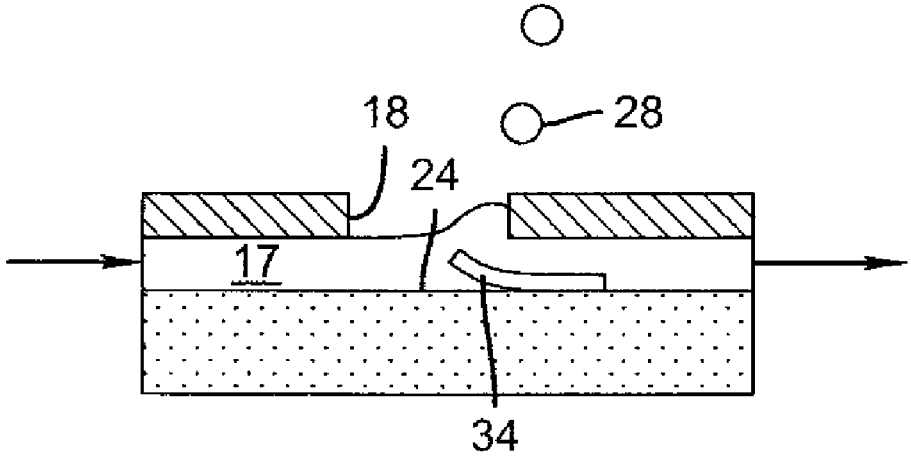
FIG. 14 is a schematic plan view of the dispenser of FIG. 13 in its "active" mode.

Referring to FIGS. 13 and 14, the walls of ejector channel 17 include a flexible portion that forms a diverter member 34. Diverter member 34 is similar to diverter member 32 of FIGS. 10 and 11, except that it is located on the lower inner wall of ejector channel 17 rather than on the its upper inner wall. Diverter member 34 may be deflected from a passive position illustrated in FIG. 13 to its active position of FIG. 14 by a thermal bimorph, piezoelectric, electrostatic or magnetic transducer.

Figure 15:
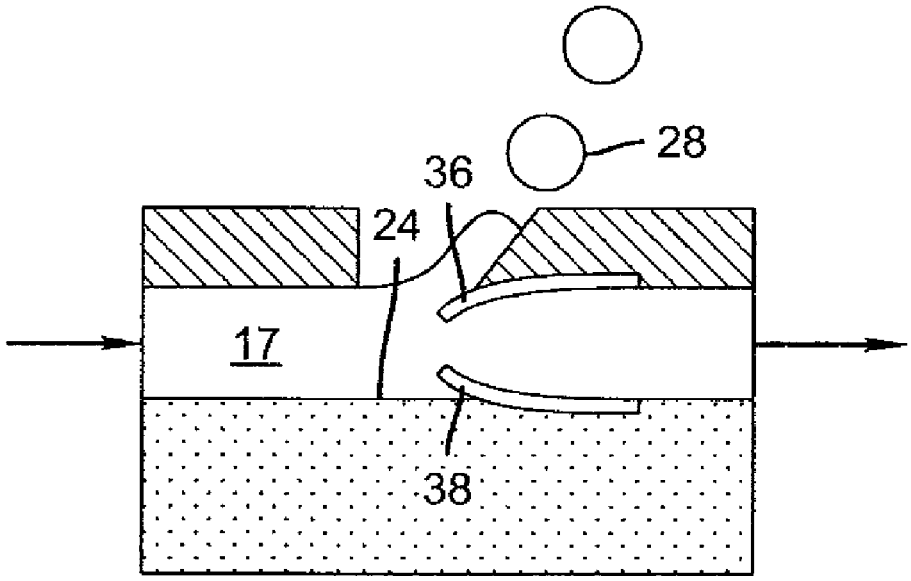
FIG. 15 is a schematic plan view of a dispenser made in accordance with still another preferred embodiment of the present invention.

In FIG. 15, a dispenser is shown using two diverter members 36 and 38 simultaneously. Both diverter members are actuated to move into ejector channel 17, thereby producing a height difference in the liquid flowing in the channel resulting in ejection of drops 28. The drops thus ejected are larger than drops that would have been ejected from either diverter member alone, as each diverter member increases the liquid height difference. As can be appreciated by one knowledgeable in the art of inkjet ejectors, the timing of activation of the two diverter members can be adjusted slightly to improve drop formation and control, so that the two diverter members are actuated at approximately, but not exactly, equal times. It will also be appreciated that diverter members 36 and 38 can be independently operated without the other to provide a degree of gray scale capability for the printhead.

Figure 16:
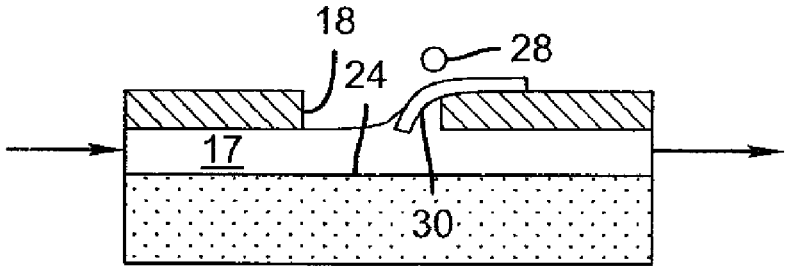
FIGS. 16-18 are detail views of a portion of the printhead of FIG. 6 showing and alternative embodiment.
Figure 17:
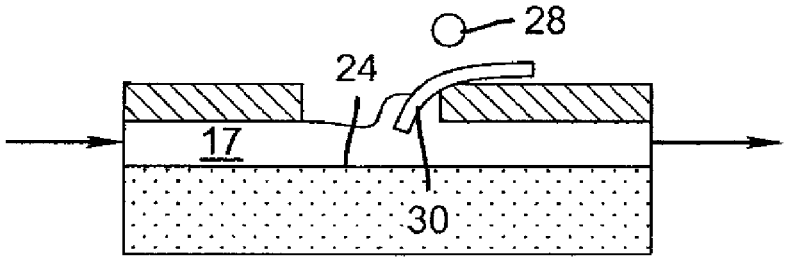
Figure 18:
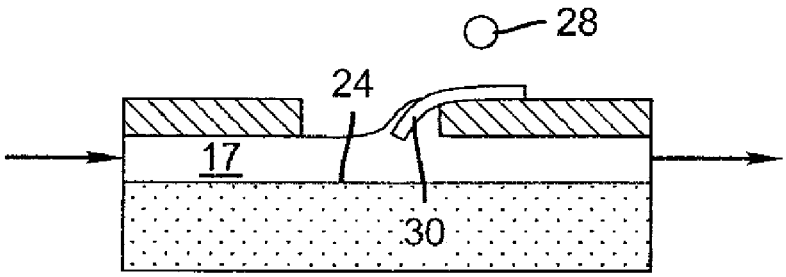

FIGS. 16-18 are detail views of a portion of the printhead of FIG. 6 showing and alternative embodiment wherein a degree of gray scale can be attained by adjusting the amount and duration of motion of diverter member 30. In FIG. 16, a small drop is produced by restricted motion and duration of deflection of the diverter member. In FIG. 17, a large drop is produced by increased motion of the diverter member for a shorter duration. In FIG. 18, a mid-sized drop is attained by restricted motion and longer duration of deflection of the diverter member.

While the foregoing description includes many details and specificities, it is to be understood that these have been included for purposes of explanation only, and are not to be interpreted as limitations of the present invention.

PARTS LIST

10. dispenser
12. supply channel
14. supply chamber
16. pump
17. ejector channel
18. outlet opening
20. diverter member
20*a*. thermal bimorph dispenser
20*b*. piezoelectric transducer dispenser
20*c*. electrostatic or magnetic transducer
21. magnetic coil
22. controller
24. wall region
26. return channel
28. droplets
30. diverter member
32. diverter member
34. diverter member
36. diverter member
38. diverter member

The invention claimed is:

1. A liquid dispenser comprising:
a liquid ejector channel including an outlet opening;
a liquid supply channel;
a liquid return channel;
a liquid supply that provides a flow of a pressurized liquid from the liquid supply channel through the liquid ejector channel and past the outlet opening to the liquid return channel, the pressurized liquid having a momentum as the liquid moves through the liquid ejector channel and past the outlet opening; and
a diverter member forming at least a portion of a wall of the liquid ejector channel, a portion of the diverter member being selectively movable into the liquid flowing through the liquid ejector channel, the momentum of the liquid causing some of the liquid to be diverted through the outlet opening when the portion of the diverter member is moved into the liquid flowing through the liquid ejector channel.

2. The liquid dispenser of claim 1, wherein the liquid flows from the liquid supply channel to the liquid return channel through the liquid ejector channel when the portion of the diverter member is not moved into the liquid flowing through the liquid ejector channel.

3. The liquid dispenser of claim 1, the diverter member including a surface along which some of the liquid flows when the portion of the diverter member is moved into the liquid flowing through the liquid ejector channel.

4. The liquid dispenser of claim 1, wherein the amount of motion of the diverter member is selectively adjustable to control diverted droplet volume.

5. The liquid dispenser of claim 1, wherein the duration of motion of the diverter member is selectively adjustable to control diverted droplet volume.

6. The liquid dispenser of claim 1, wherein the liquid dispenser has a response frequency greater than 400 kHz.

7. The liquid dispenser of claim 1, wherein the diverter member is selected from the group consisting of a thermal bimorph transducer, a piezoelectric transducer, an electrostatic transducer, and a magnetic transducer.

8. The liquid dispenser of claim 1, wherein the diverter member is positioned outside of the liquid supply channel.

9. The liquid dispenser of claim 1, wherein the diverter member is positioned within the liquid supply channel.

10. The liquid dispenser of claim 9, wherein the diverter member is on a wall member opposed to the outlet opening.

11. The liquid dispenser of claim 1, wherein the diverter member comprises a plurality of simultaneously movable members.

12. The liquid dispenser of claim 11, wherein the movable members are independently movable.

* * * * *